US011633642B2

(12) United States Patent
Lamarque

(10) Patent No.: US 11,633,642 B2
(45) Date of Patent: Apr. 25, 2023

(54) WEIGHTLIFTING APPARATUS FOR PROVIDING INCREASED INITIAL LIFTING WEIGHT

(71) Applicant: Matthew Justin Lamarque, Monterey, CA (US)

(72) Inventor: Matthew Justin Lamarque, Monterey, CA (US)

( * ) Notice: Subject to any disclaimer, the term of this patent is extended or adjusted under 35 U.S.C. 154(b) by 45 days.

(21) Appl. No.: 17/170,089

(22) Filed: Feb. 8, 2021

(65) Prior Publication Data

US 2022/0249897 A1 Aug. 11, 2022

(51) Int. Cl.
*A63B 21/075* (2006.01)
*A63B 21/06* (2006.01)
*A63B 21/072* (2006.01)

(52) U.S. Cl.
CPC ..... *A63B 21/075* (2013.01); *A63B 21/0615* (2013.01); *A63B 21/0728* (2013.01)

(58) Field of Classification Search
CPC .. A63B 1/00–005; A63B 21/072–0783; A63B 21/08; A63B 21/16; A63B 21/0615; A63B 21/4047; A63B 2244/09
See application file for complete search history.

(56) References Cited

U.S. PATENT DOCUMENTS 4,344,619 A * 8/1982 Szabo ..... A63B 21/0615 248/161
4,357,010 A * 11/1982 Telle ..... A63B 21/4047 482/97
4,890,831 A * 1/1990 Craig ..... A63B 21/0724 482/104
5,116,297 A * 5/1992 Stonecipher ..... A63B 21/4035 482/137
5,194,060 A * 3/1993 Marchetti ..... A63B 21/4047 482/133
5,310,393 A * 5/1994 Highsmith ..... A63B 21/0615 482/148
5,356,359 A * 10/1994 Simmons ..... A63B 21/4035 482/142
5,813,951 A * 9/1998 Einsig ..... A63B 21/0615 482/110
6,447,433 B1 * 9/2002 Reyes ..... A63B 21/078 482/104
6,652,432 B2 11/2003 Smith
10,004,934 B2 6/2018 Pennington
2010/0242644 A1 * 9/2010 Farbshteyn ..... A63B 21/0628 74/102

(Continued)

*Primary Examiner* — Loan B Jimenez
*Assistant Examiner* — Kathleen M Fisk
(74) *Attorney, Agent, or Firm* — Patrick Reilly

(57) ABSTRACT

This invention in the field of weightlifting assists a weightlifter in training more effectively, by providing an apparatus for decreasing weight during a weightlifting movement, such that more weight is lifted initially than must be set down again afterward. The apparatus consists generally of an arm extending from a hinge anchored at a fixed height, such that the arm may be placed atop a bar or barbell to be lifted. When the bar is lifted, the arm's position relative to the hinge causes the arm to fall off of the bar and remove the weight of the arm from the weight being lifted by the weightlifter. Thus, the amount of weight the weightlifter is lowering back down again is reduced compared to the amount of weight the weightlifter initially lifted.

20 Claims, 7 Drawing Sheets

(56) References Cited

U.S. PATENT DOCUMENTS

| | | | | |
|---|---|---|---|---|
| 2014/0073492 | A1* | 3/2014 | Hunter | A63B 21/0615<br>482/98 |
| 2017/0087402 | A1* | 3/2017 | Chen | A63B 23/03575 |
| 2019/0275363 | A1* | 9/2019 | Jones | A63B 21/4035 |
| 2019/0282847 | A1 | 9/2019 | Acuna | |
| 2020/0147439 | A1 | 5/2020 | Acuna | |

* cited by examiner

WEIGHTLIFTING APPARATUS FOR PROVIDING INCREASED INITIAL LIFTING WEIGHT

FIELD OF THE INVENTION

The field of the invention relates to weightlifting, and particularly to an apparatus for adding more weight to be lifted initially, then removing the added weight partway through the lift.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Weightlifting and strength training are well established as forms of exercise for building muscle, strengthening the body, and supporting one's health. There are many varieties of physical training that utilize weights or heavy objects to provide resistance for one's muscles to work against, and competitive weightlifting is a professional sport. At high levels, the efficiency of weightlifting training reaches a plateau, such that methods of training already known in the art return only minimal or incremental improvement to one's already advanced weightlifting capacity, even while weightlifters may still endeavor to develop their abilities even further. Therefore, there is a long-felt need in the field of weightlifting training to provide a device and method that makes available more productive weightlifting training even for those already at high levels of weightlifting proficiency.

As physical training professionals may be aware, human muscles are most trainable in fully extended positions; this is one of the principles behind the methodology of Pilates, for one. When a weightlifter is doing a deadlift, that is lifting a weighted bar or barbell from a resting position on the floor, up to a certain height, then back down to the floor again, the weightlifter's arm muscles are most extended when the weightlifter reaches down to lift the barbell from the floor; this is also the moment at which most deadlifts fail if the deadlift fails at all, and it's unusual for a weightlifter to falter after the bar has successfully left the ground. Therefore, while a weightlifter trains by lifting a bar from the floor to a raised position and then reversing the motion to set the bar back down again, it's really that initial lift of the bar from the floor that is most valuable for advancing the weightlifter's training, even while the weightlifter can't safely just drop the bar after that and hence the weightlifter still has to expend their limited energy on performing the entire movement. Thus, as a weightlifter's capacity for lifting increases and the weightlifter lifts heavier weights in training, the efficiency of their training sessions diminishes because the 'overhead' energy cost of doing less-productive lifting—the rest of the lifting motion after the initial productive lift from the floor—gets steeper. Therefore, a method of weightlifting training wherein the initial startup lift is made heavier than the less-productive remainder of the exercising movement, or said alternately, the remaining movement made into a lighter lifting weight regardless of the weight lifted initially, might make available more efficiency in weightlifting training, even allowing the best weightlifters to take their discipline to a level previously unavailable.

In view of this opportunity to address the long-felt need for more efficient weight training especially at high skill levels, there is therefore an imperative in the art to provide a weight training device that provides increased lifting weight for the initial upward motion of a deadlift and then reduces the weight after the bar is partially lifted, and to provide a method for weight training in this manner.

SUMMARY OF THE INVENTION

Towards these and other objects of the method of the present invention (hereinafter, "the invented method") that are made obvious to one of ordinary skill in the art in light of the present disclosure, what is provided is a weightlifting apparatus for adding more weight onto an initial bar lift, that is then removed by the apparatus once the bar is lifted to a certain height. Certain preferred embodiments may consist of or comprise an invented exercising apparatus consisting of a support structure that anchors a hinged, weighted bar, suitable for performing an invented exercise wherein one positions the distal end of the hinged bar atop the center of a barbell, then lifts the barbell, such that the end of the hinged bar falls off of the barbell partway through the lift, decreasing the resistance of the lift partway through.

In a first preferred embodiment of the invented device, the apparatus consists of a frame structure coupled to and anchoring a fixed, hinged end of an extended length, such that the extended length pivots around the anchored end, and the free end of the extended length may swing freely up or down. The extended length may have one or more fixtures for adding weight additional to the weight of the extended length itself, such as smaller lengths extending from the upper surface on which weights such as those having standard holes in the center may be placed or stacked.

A preferred method of exercising using the invented apparatus consists of (1.) placing a weightlifting bar such as a barbell or similar on the ground beside the apparatus such that the free end of the extended length of the invented apparatus sits atop the center of the barbell; (2.) lifting the barbell with the extended length of the invented device positioned atop the center of the bar and thus adding on weight to be lifted; (3.) lifting the bar to a height such that the angle of the extended length of the invented apparatus causes the extended length to fall off of the center of the bar and fall back down to the ground, thus removing the extra weight from the total weight being lifted; and (4.) completing the lift normally, with just the weight of the barbell. A user may also stand closer to the fixed point of the invented device to reduce the weight temporarily added to the lift by the extended length (using the lever effect; lifting the extended length by the distal end is 'heavier' than lifting the same extended length at a point closer to the fulcrum) and change the timing of when the extended length falls from atop the barbell.

In various preferred embodiments, the invented device may vary in implementation, dimensions, materials, or other logistical considerations of manufacture. In an additional preferred embodiment, the invented device may not have a frame, and instead the fixed end of the extended length may be anchored to a point on a wall (with suitable structural support) instead of to a freestanding frame, may be anchored to the floor, or may be anchored to another structure rather than having a dedicated supporting frame, such as to a sawhorse or to a point on the side of an exercise machine. The fixture or station at which the invented device is installed might optionally include one or more marks or decals on the floor indicating where the user should stand, or even a 'landing pad' for the extended length to fall onto, as a measure to reduce wear and tear on the extended length, or the floor, from the extended length repeatedly hitting the floor, and also reduce any potential risk of smashed toes. Various embodiments of the invention might be constructed such that certain embodiments are portable or collapsible for storage, adjustable in size or dimensions, or otherwise adjustable or configurable.

In one embodiment, the extended length and frame might be constructed from plywood. The invented device or constituent components thereof may be constructed of varying materials as known in the art and deemed suitable, such as wood, metal, plastic, hard rubber, foam, or other materials as found to be suitable. The ideal height at which the anchored end of the extended length should be fixed might depend on the height or posture of the user, so variously tall or short support frames might easily be additional embodiments of the invention; a frame or fixture point having adjustable height might also be a preferred embodiment. It is noted that the materials of which the invented device is constructed may also affect the amount of weight that a user might expect to lift when using the invented device.

Additionally, the extended length may measure any suitable length for practicing the described invention; generally, as a point of stating how best the invention might be practiced, a length of five or six feet (about 2 meters) might be reasonably preferable to most users. However, it should be noted that the invented device is not limited to an embodiment having specific dimensions or measurements, or restricted to the most optimal available embodiment. One skilled in the art might easily recognize that making the extended length superlatively short might prevent one from being able to use the device to practice the invented method of exercise, and making the extended length superlatively long might, at some point, reach a level of absurdity or impracticality, such as at least by making the invented device difficult to store when not in use, requiring an accordingly long space in which to operate or store the device, or providing an extended length that adds an amount of weight unsuitable for the user to exercise with.

It is noted that the described method of exercise is not the only exercise that might be done using the invented device, and that making a new tool available generally enables fresh innovation in the art. Further, it is noted that use of the invented device adds benefit to a weightlifting motion that weightlifters already generally know how to do, namely the deadlift—lifting a barbell from the floor to a certain height, then subsequently setting the barbell back down on the floor again—and that one skilled in the art of weightlifting would understand that continuing the lift 'as one normally would' after the arm of the invented device has fallen from the lifted bar might consist of continuing the lift to whatever highest point is deemed appropriate, such as the level of one's hips which is common in many deadlifts, and then placing the barbell back on the ground. Further, one skilled in the art of weightlifting may understand that the weightlifting motion is mostly the same once the arm of the device has been placed atop the bar to be lifted, and a key difference is that the weight load is reduced during the less-productive 'overhead cost' part of the usual deadlift motion as compared to the initial lift from the floor.

In certain preferred embodiments, the invented device may comprise or include an elongate bar with a proximate end and a rotatable end, and an anchor means rotatably and fixedly coupled with the rotatable end. The device may further comprise a removable weight detachably coupled with the elongate bar.

The anchor means may be comprised within a freestanding frame. The freestanding frame may comprise a central beam extending substantively horizontally and perpendicularly from the elongate bar. The freestanding frame may further comprise at least one stabilizing leg extending substantively horizontally from the central beam. The at least one stabilizing leg may extend substantively perpendicularly from the central beam. The freestanding frame may further comprise a second stabilizing leg extending substantively horizontally from central beam. The at least one stabilizing leg and the second stabilizing leg may each extend substantively perpendicularly from the central beam. The at least one stabilizing leg and the second stabilizing leg may each extend substantively in parallel with the elongate bar. The at least one stabilizing leg and the second stabilizing leg may each extend substantively in parallel with the elongate bar and toward the elongate bar proximate end. The at least one stabilizing leg and the second stabilizing leg may each extend substantively in parallel with the elongate bar and away from the elongate bar proximate end. The at least one stabilizing leg and the second stabilizing leg may each extend substantively toward the elongate bar proximate end. The at least one stabilizing leg and the second stabilizing leg may each extend substantively away from the elongate bar proximate end.

The invented device may also comprise or include an elongate bar with a proximate end and a rotatable end, and an anchor means rotatably coupled with the rotatable end. The anchor means may be coupled with a building structure. An additional weight may be detachably attached to the elongate bar. The anchor means can be positioned no more than three feet above the floor. The invented device may further comprise a barbell positioned underneath and perpendicular to the elongate bar, proximate to the proximate end. The barbell may be positioned between the user and the anchor means when causing the vertical lifting of the barbell.

Further, the invention also includes an invented method for using the invented device in weight training, which may comprise or include:

- positioning a barbell underneath the elongate bar, proximate to the proximate end;
- initiating a vertical lifting of the barbell with the elongate bar positioned on top of the barbell;
- continuing the vertical lifting of the barbell such that a limited arc of motion of the elongate bar causes the elongate bar to fall off of the barbell; and
- continuing the vertical lifting and setting down of the barbell free of the temporary extra weight of the elongate bar.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

INCORPORATION BY REFERENCE

All publications, patents, and patent applications mentioned in this specification are herein incorporated by reference to the same extent as if each individual publication, patent, or patent application was specifically and individually indicated to be incorporated by reference.

Such publications include U.S. Pat. No. 8,974,354 (inventor: Nelson et al.; issued on Mar. 10, 2015) titled "Landmine apparatuses"; U.S. Pat. No. 7,537,552 (inventor: Dalebout et al.; issued on May 26, 2009) titled "Exercise device with centrally mounted resistance rod and automatic weight selector apparatus"; U.S. Pat. No. 8,936,537 (inventor: Hoole; issued on Jan. 20, 2015) titled "Exercise Arm Apparatus and Method of Use"; U.S. Pat. No. 9,339,692 (inventor: Hashish; issued on May 17, 2016) titled "Exercise system for shifting an optimum length of peak muscle tension"; U.S. Patent Pub. No. 2019/0151716A1 (inventor: Bird; published on May 23, 2019) titled "Resistance apparatus, system, and method"; U.S. Pat. No. 7,682,295 (inventor: Hulls; issued on Mar. 23, 2010) titled "Multiple resistance curves used to vary resistance in exercise apparatus"; and U.S. Patent Pub. No. 2004/0009854 (inventor: Shiang; published on Jan. 15, 2004) titled "Method and apparatus for training muscle strength through progressive resistance exercise"; U.S. Pat. No. 4,949,951 titled "Body building exercise device" issued on Aug. 21, 1990 to inventor James A. Deola; U.S. Pat. No. 4,934,695 titled "Exercising apparatus" issued on Jun. 19, 1990 to inventor Friedrich Wolff; U.S. Pat. No. 4,858,915 titled "Weight-biased fitness machine" issued on Aug. 22, 1989 to inventor William J. Szabo; U.S. Pat. No. 4,856,773 titled "Weightlifting exercise device" issued on Aug. 15, 1989 to Inventor James A. Deola; U.S. Pat. No. 4,784,384 titled "Weightlifting exercise device" issued on Nov. 15, 1988 to Inventor James A. Deola; U.S. Pat. No. 4,730,829 titled "Exercise machine" issued on Mar. 15, 1988 to Inventor Robert Carlson; and U.S. Pat. No. 4,720,099 titled "Exercise machine" issued on Jan. 19, 1988 Inventor Robert Carlson.

The publications discussed or mentioned herein are provided solely for their disclosure prior to the filing date of the present application. Nothing herein is to be construed as an admission that the present invention is not entitled to antedate such publication by virtue of prior invention. Furthermore, the dates of publication provided herein may differ from the actual publication dates which may need to be independently confirmed.

BRIEF DESCRIPTION OF DRAWINGS

The detailed description of some embodiments of the invention is made below with reference to the accompanying figures, wherein like numerals represent corresponding parts of the figures.

DETAILED DESCRIPTION OF DRAWINGS

In the following detailed description of the invention, numerous details, examples, and embodiments of the invention are described. However, it will be clear and apparent to one skilled in the art that the invention is not limited to the embodiments set forth and that the invention can be adapted for any of several applications.

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims.

Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

When elements are referred to as being "connected" or "coupled," the elements can be directly connected or coupled together or one or more intervening elements may also be present. In contrast, when elements are referred to as being "directly connected" or "directly coupled," there are no intervening elements present.

Throughout this specification, like reference numbers signify the same elements throughout the description of the figures.

Figure 1:
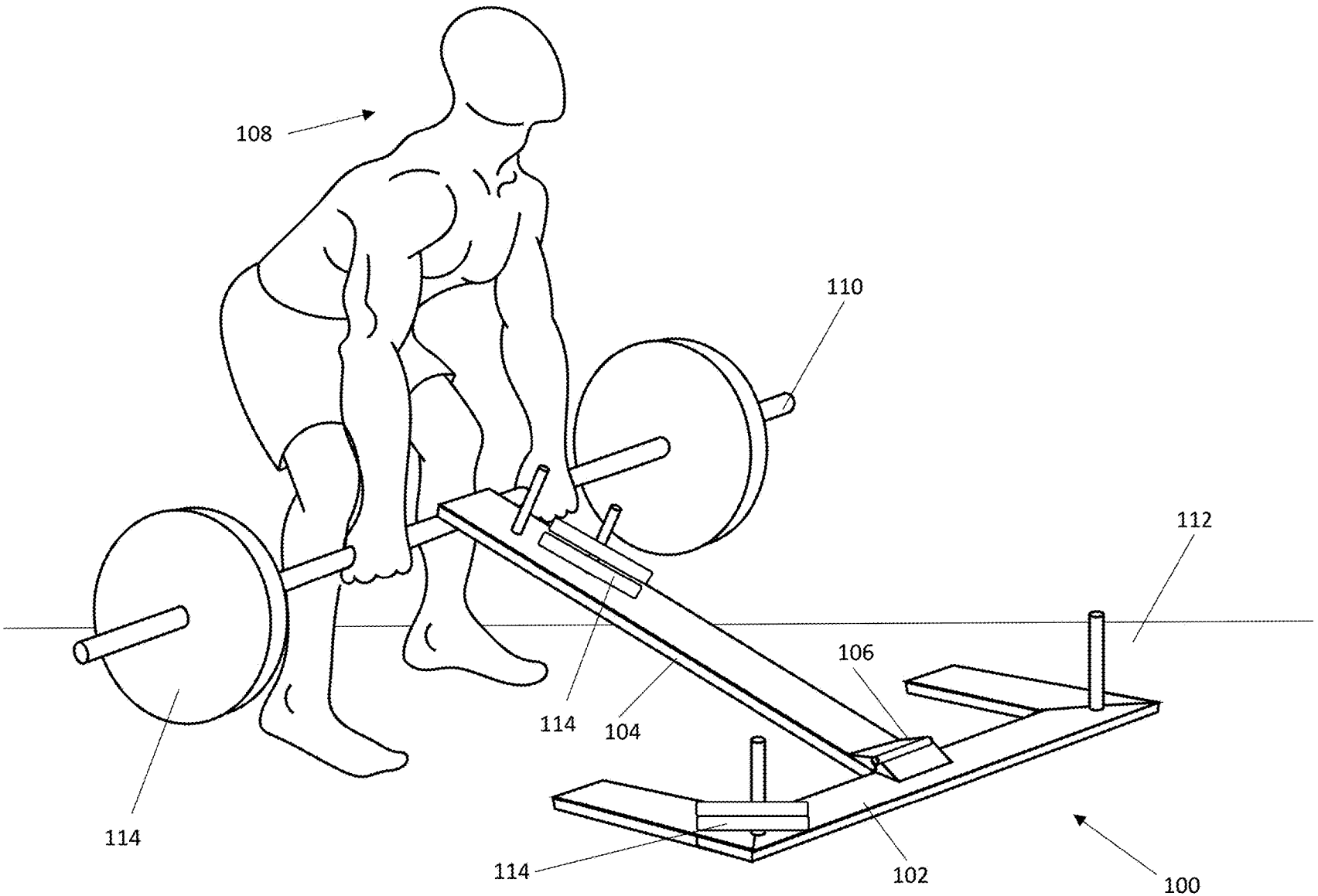
FIG. 1 is an overview diagram presenting the invented apparatus in use by a weightlifter in accordance with the invented method.

Referring now generally to the Figures and particularly to FIG. 1, FIG. 1 is an overview diagram presenting an invented apparatus 100 with a frame 102, an arm 104, and a hinge 106, in use by a weightlifter 108 in accordance with the invented method. In preferred application in accordance with the invented method, the weightlifter 108 positions a bar 110 to be lifted, underneath the arm 104 of the apparatus 100. The apparatus 100 rests on the floor 112, and weights 114 may be added to anchor the apparatus 100, add more weight to the arm 104, or add more weight to the bar 110. The weightlifter 108 exercises by lifting the bar 110, causing the arm 104 to fall from atop the bar 110 when the bar 110 reaches a certain height. Afterward, the weightlifter 108 safely completes the lifting of the bar 110, and sets the bar 110 back down on the floor 112.

Figure 2:
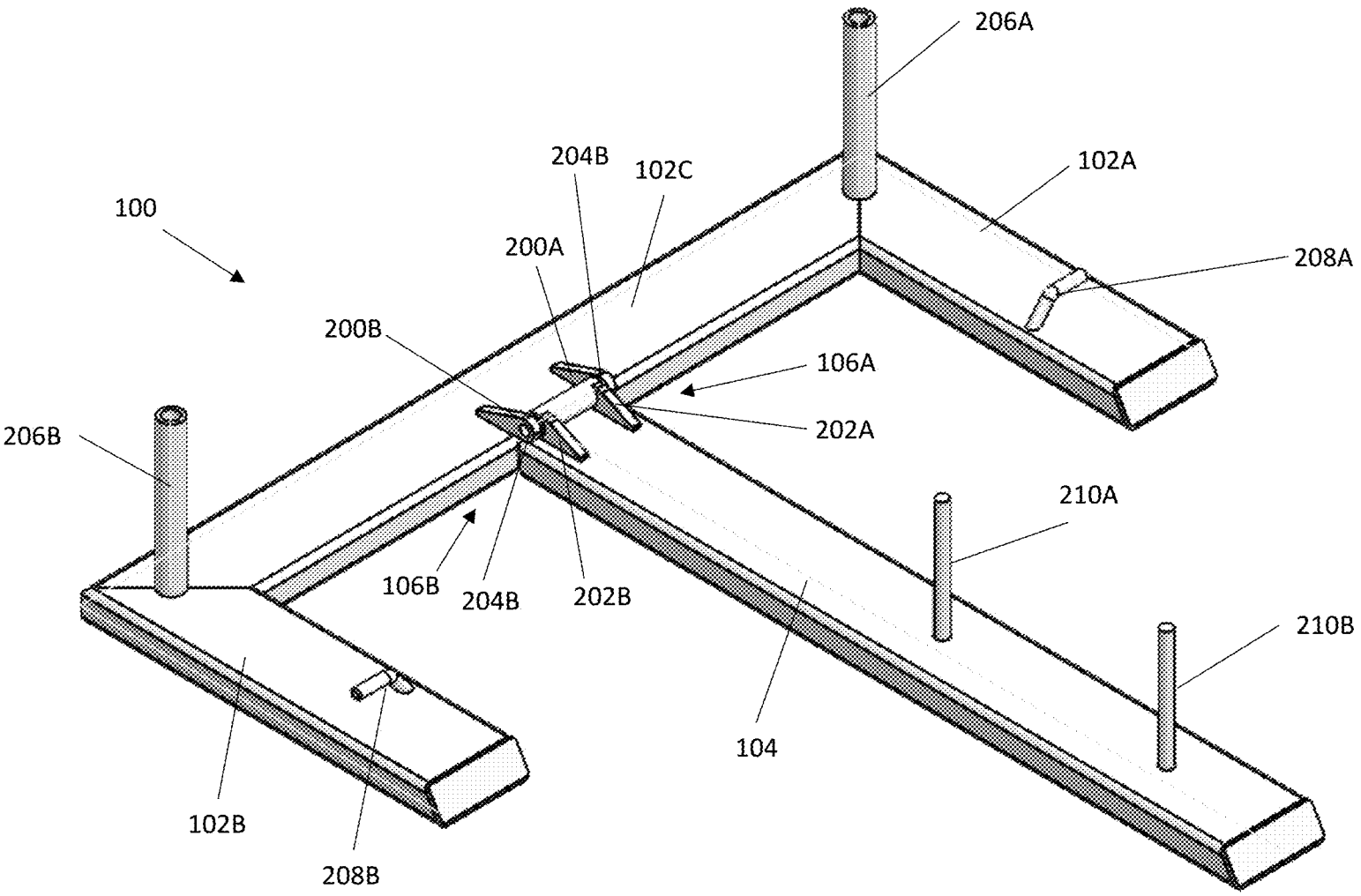
FIG. 2 is a diagram of the invented apparatus of FIG. 1 with elements labeled in further detail.

Referring now generally to the Figures and particularly to FIG. 2, FIG. 2 is a diagram of the invented apparatus 100 of FIG. 1 with elements labeled in further detail. In this embodiment, the arm 104 is anchored to a freestanding frame 102 that rests mostly on the floor 110. The frame 102 as presented here is constructed of three pieces: a right frame side 102A, a left frame side 102B, and a frame center 102C. The right frame side 102A and the left frame side 102B are stabilizing legs, contributing to maintaining the stability, balance, and positioning of the frame 102 overall while practicing the invented method. This is only one way the frame 102 might be constructed such that the invented apparatus 100 is suitable for practicing the invented method, and should not be construed as a limitation. The arm 104 is coupled to the center of the frame 102 by the hinge 106. The hinge 106 might be further subdivided into a hinge frame side left 200A, a hinge frame side right 200B, a hinge arm side right 202A, a hinge arm side left 202B, and a bolt 204; this embodiment presents two smaller hinges, a right hinge 106A and a left hinge 106B, instead of a single hinge 106, which may also be suitable. It is noted that many different designs of hinge are known in the art, and several of these may be suitable for this application; the hinge 106, or the left hinge 106B and the right hinge 106A, as disclosed herein should be considered as representing any suitable hinge assembly known in the art, or indeed any suitable means for rotatably anchoring the arm 104 and providing an anchor means suitable for supporting practice of the invention as described herein. At either corner of the frame 102 are a right frame spindle 206A and a left frame spindle 206B, on which weights 114 can be placed to anchor the frame 102, such that it is significantly more difficult to accidentally move or lift the frame 102 along with the arm 104 when exercising. A right elastic band anchors 208A and a left elastic band anchor 208B are positioned on and extend from the frame 102, and are shaped to accept elastic bands that may simultaneously be attached or indirectly mechanically coupled to the bar 110 to add further resistance to movement of the bar 110 away from either the right elastic band anchor 208A or the left elastic band anchor 208B or both.

The frame 102 may be made of steel, heavyweight steel, a hard metal, or any other suitable material known in the art in combination or in singularity, and preferably weighs within the range of 80 pounds to 120 pounds.

Additionally, a proximal arm spindle 210A and a distal arm spindle 210B provide secure fixtures for removably placing weights 114 onto the arm 104, such that the amount of temporary weight added to the lift by use of the apparatus 100 in accordance with the invented method can be adjusted as preferred. In some embodiments of the invention, only a single arm spindle 210 may be provided. Having a proximal arm spindle 210A and a distal arm spindle 210B may provide at least the additional benefit of an additional modifier to the perceived weight of any weights 114 added to the arm 104 this way, as the any weight 114 placed on the distal arm spindle 210B will require more strength to lift than the same weight placed on the proximal arm spindle 210A instead, as the arm 104 is a lever structure, and the proximal arm spindle 210A is positioned closer to the fulcrum.

It is noted that other means for removably attaching additional weight to the arm 104 are known in the art and might be used instead or in addition if preferred, and also noted that in many preferred applications of the invented method, the arm 104 falls down and impacts on the floor 112, and the safety of a user's feet may be a factor in determining preferred methods of attaching weight to the arm 104.

Figure 3:
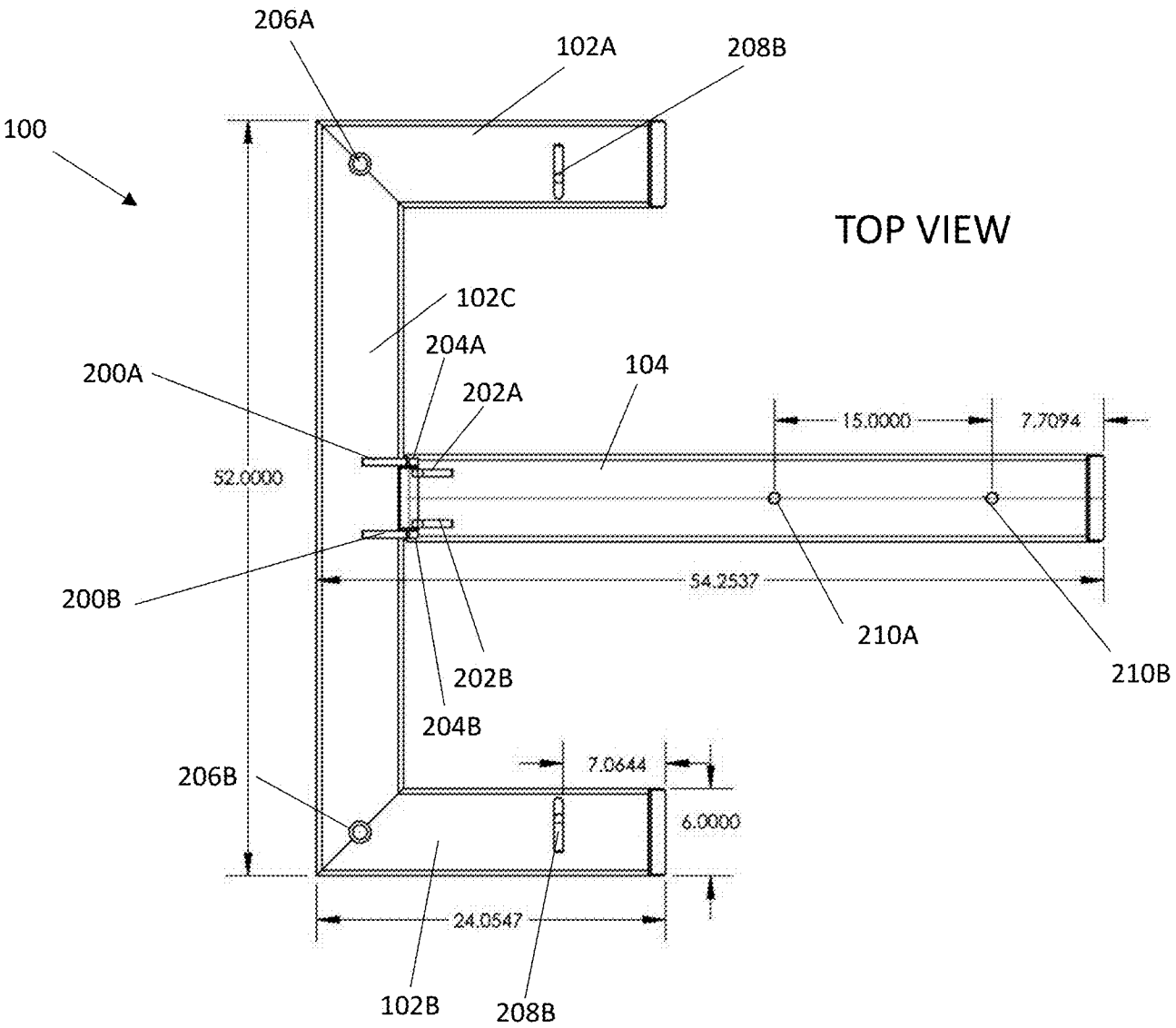
FIG. 3 is a diagram presenting a top view of the invented apparatus of FIG. 1.

Referring now generally to the Figures and particularly to FIG. 3, FIG. 3 is a diagram presenting a top view of the invented apparatus 100 of FIG. 1. While measurement labels are present, the invention is not limited to these particular measurements as shown, and these might be considered an indication of preference in optimal manufacture.

Figure 4:
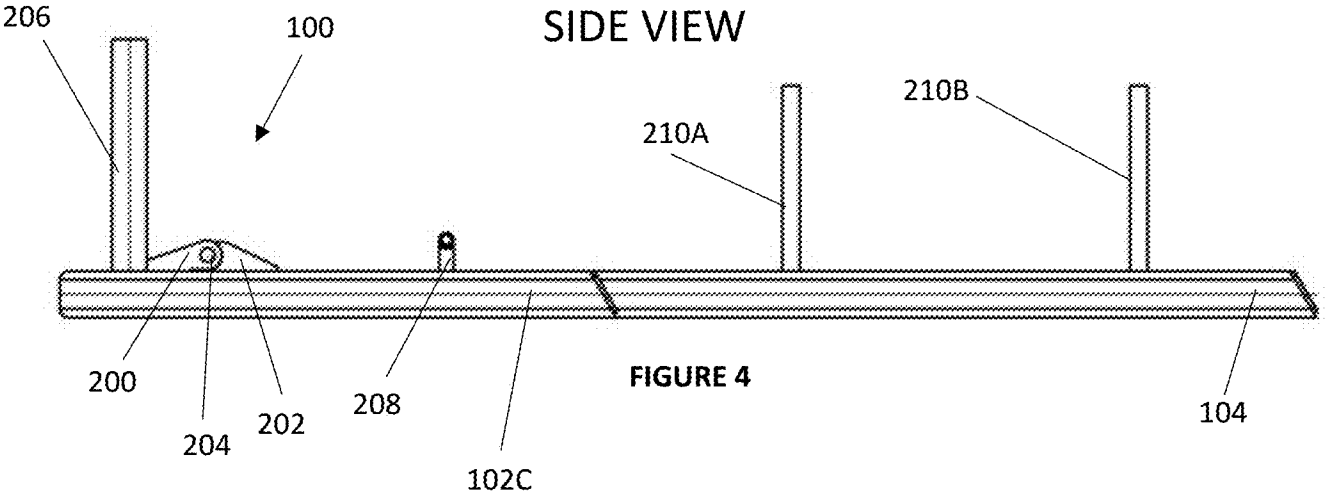
FIG. 4 is a diagram presenting a side view of the invented apparatus 100 of FIG. 1.

Referring now generally to the Figures and particularly to FIG. 4, FIG. 4 is a diagram presenting a side view of the invented apparatus 100 of FIG. 1.

Figure 5:
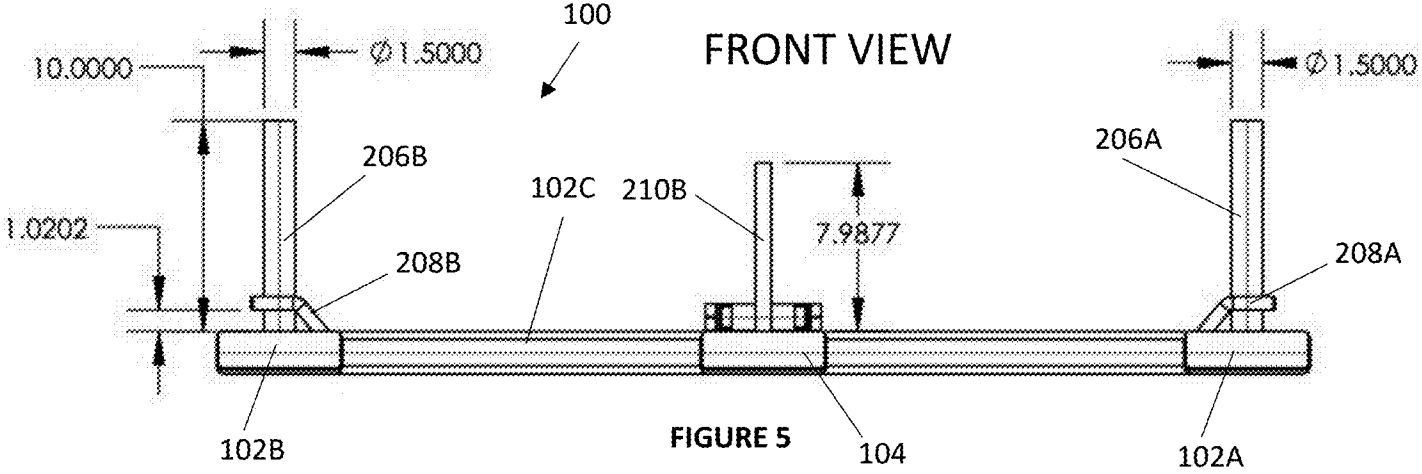
FIG. 5 is a diagram presenting a front view of the invented apparatus of FIG. 1.

Referring now generally to the Figures and particularly to FIG. 5, FIG. 5 is a diagram presenting a front view of the invented apparatus 100 of FIG. 1. While measurement labels are present, the invention is not limited to these particular measurements as shown, and these might be considered an indication of preference in optimal manufacture.

Figure 6A:
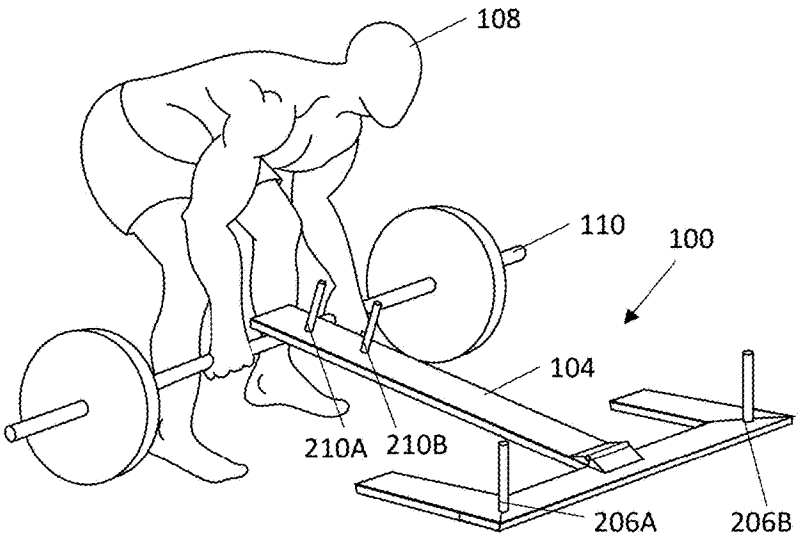
FIG. 6A is a first of a series of diagrams presenting the invented exercise performed with the invented apparatus of FIG. 1, wherein the weightlifter places the arm of the apparatus atop the bar to be lifted.

Referring now generally to the Figures and particularly to FIG. 6A, FIG. 6A is a first of a series of diagrams presenting the invented exercise performed with the invented apparatus of FIG. 1, wherein the weightlifter 108 places the arm 104 of the apparatus 100 atop the bar 110 to be lifted, as a preliminary step prior to beginning the lifting of the bar 110 with the temporary added weight provided by the arm 104. It is noted that, in FIGS. 6A through 6B, the weight added in the diagram consists solely of the weight of the arm 104 itself, and that additional weight might be added to that amount by placing of one or more additional weights 114 on either the proximal arm spindle 210A, the distal arm spindle 210B, or both, as preferred by the weightlifter 108. One or more additional weights 114 may also be placed on the right frame spindle 206A or the left frame spindle 206B to anchor the frame 102 more securely.

Figure 6B:
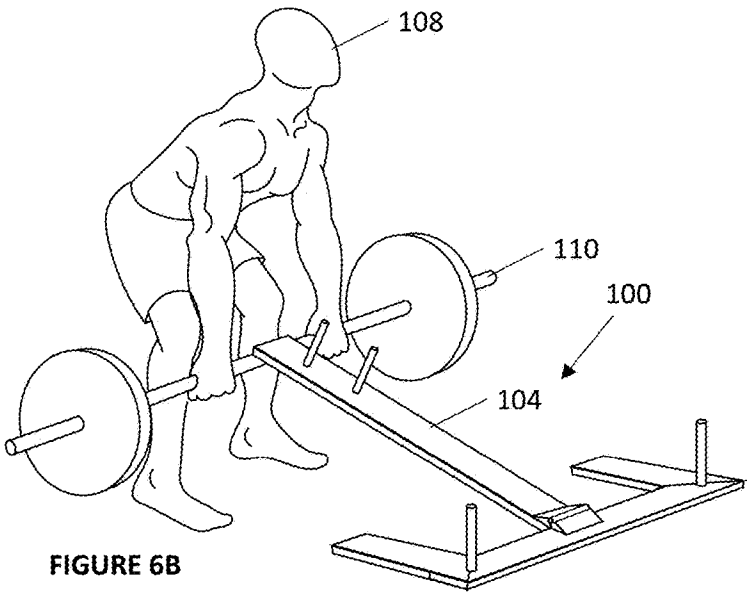
FIG. 6B is a second of a series of diagrams presenting the invented exercise performed with the invented apparatus of FIG. 1, wherein the weightlifter lifts the bar with the arm remaining on top of the bar and adding weight.

Referring now generally to the Figures and particularly to FIG. 6B, FIG. 6B is a second of a series of diagrams presenting the invented exercise performed with the invented apparatus of FIG. 1, wherein the weightlifter 108 lifts the bar 110 with the arm 104 remaining on top of the bar 110 and adding weight. It is noted that this initial lift of the weight from a resting position is the portion of the lifting of the weight when the weightlifter's muscles are most extended, and therefore capable of being strengthened most efficiently; therefore, providing extra weight at this point in the exercise increases the benefit of performing this lift, without the drawback of having to lift that same increased weight for the whole movement, even the portion of the lift that is less productive.

Figure 6C:
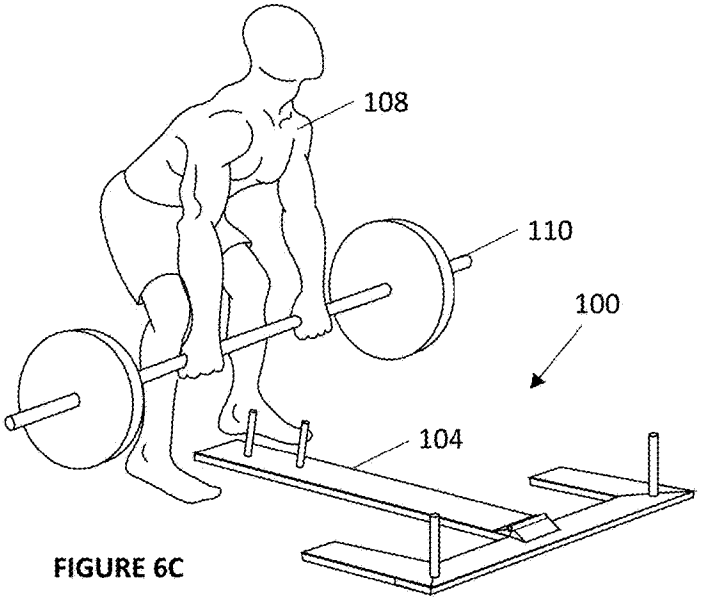
FIG. 6C is a third of a series of diagrams presenting the invented exercise performed with the invented apparatus of FIG. 1, wherein the angle of the arm causes the arm to fall from the bar, reducing the quantity of weight being lifted by the weightlifter.

Referring now generally to the Figures and particularly to FIG. 6C, FIG. 6C is a third of a series of diagrams presenting the invented exercise performed with the invented apparatus of FIG. 1, wherein the angle of the arm 104 as the bar 110 is lifted causes the arm 104 to fall from the bar 110, reducing the total quantity of weight being lifted by the weightlifter 108. It is noted that once the lifted weight has left the ground, the remainder of the weightlifting exercise is less productive than the initial lift, but the weightlifter 108 is still constrained to expend the physical effort of continuing the rest of the lift and setting the bar 110 down again; simply dropping the bar 110, for instance, would not generally be considered safe to do. However, by reducing the lifted weight amount at this point, the invented method of exercise allows for lowering of the 'overhead cost' to the weightlifter's energy of continuing the lift and setting the bar 110 back down again, allowing the weightlifter to save more of their workout energy budget for the productive lifting instead.

Figure 6D:
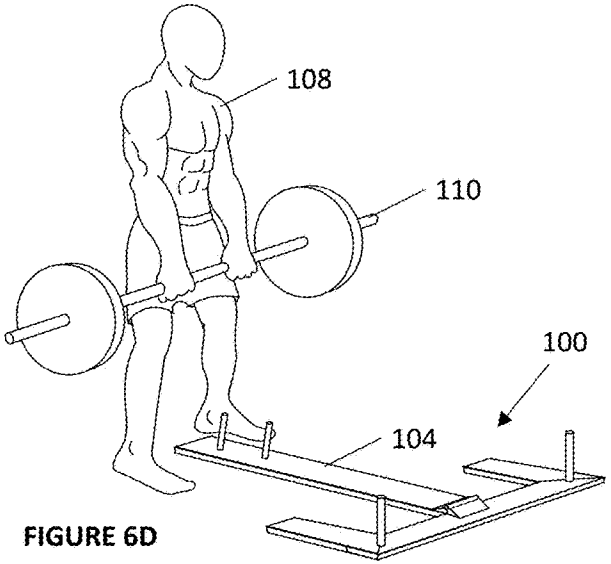
FIG. 6D is a fourth of a series of diagrams presenting the invented exercise performed with the invented apparatus of FIG. 1, wherein the weightlifter completes the weightlifting movement by continuing to lift the bar, then lowering the bar back to the floor.

Referring now generally to the Figures and particularly to FIG. 6D, FIG. 6D is a fourth of a series of diagrams presenting the invented exercise performed with the invented apparatus 100 of FIG. 1, wherein the weightlifter 108 completes the weightlifting movement by continuing to lift the bar 110 as the weightlifter 108 would ordinarily. It is noted that still images do not necessarily encompass the full motion, which consists of continuing to lift the bar 110 as far upward as preferred (which need not be much further, particularly in training that focuses on the initial raise from the floor), then lowering the bar 110 back down to the floor safely. It is noted that the anticipated benefit of the invented exercise, as explicated in the background section, is reduction of total lifted weight during the less-productive portion of the weightlifting movement, as the lowering of the bar 110 back to the floor 112 is not very productive for increasing one's lifting capacity, but takes energy and cannot be simply skipped over (such as by dropping the bar 110, which is not a good idea) in order to conserve more energy for the 'real' weightlifting.

Figure 7:
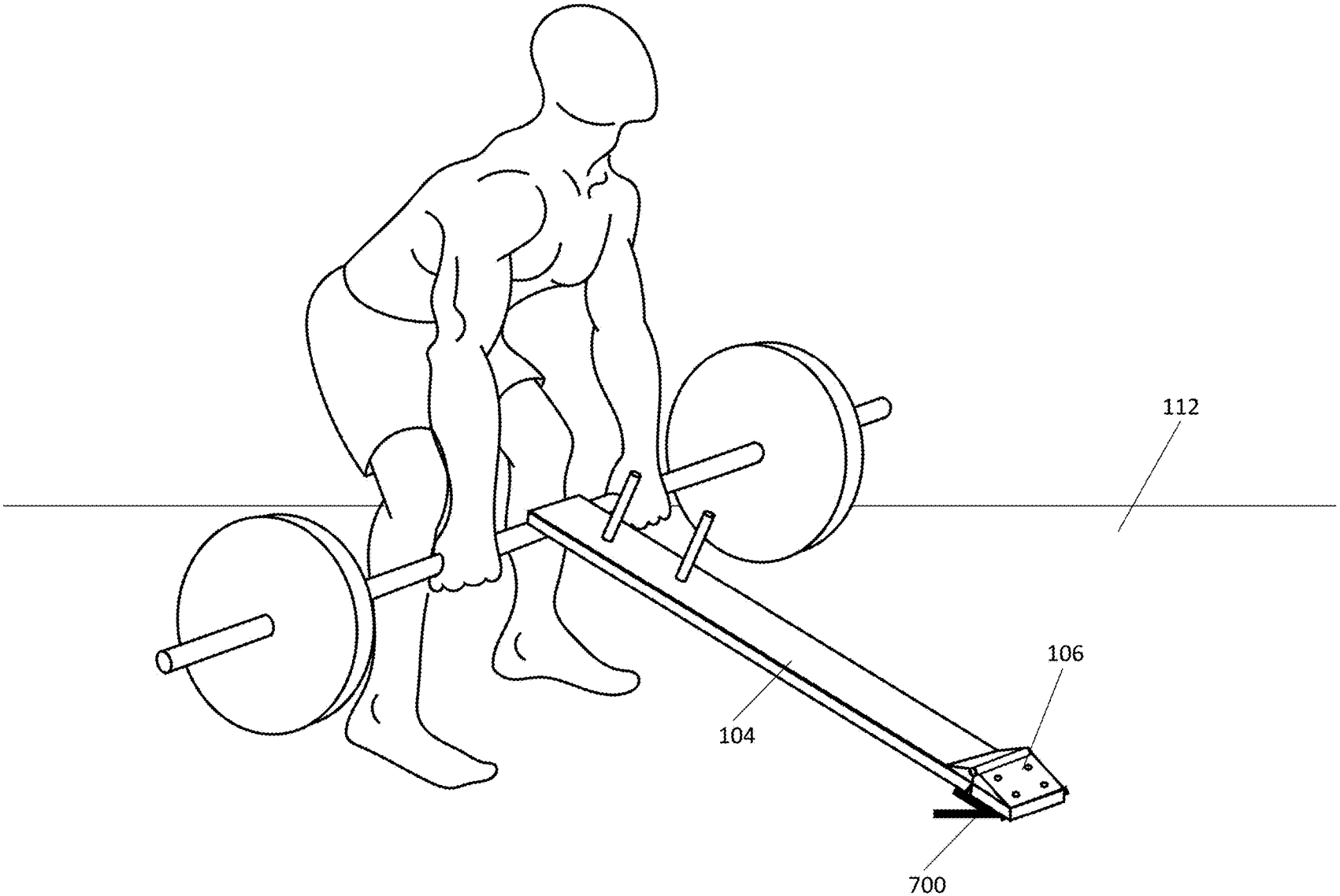
FIG. 7 is an alternate embodiment of the apparatus of FIG. 1, with no frame and the arm anchored to the floor instead.

Referring now generally to the Figures and particularly to FIG. 7, FIG. 7 is an alternate embodiment of the apparatus of FIG. 1, with no frame 102 and the arm 104 and hinge 106 anchored to the floor 112 instead by means of a floor fixture 700. The floor fixture 700 may include one or more plates or pieces of material to which the hinge 106 of the invented device is bolted or otherwise coupled, such that the hinge 106 is coupled securely to the floor 112. It is noted that the hinge 106 might also be bolted or coupled directly to the floor 112, depending on the circumstances, the preferences of the owner of the floor 112, and the discretion of an expert such as a contractor doing any necessary bolting or coupling. This is one possible example of the invented device being anchored to a building structure, rather than a freestanding frame. Other similar building structure anchorings may naturally include similar anchoring to a wall instead of a floor.

Figure 8:
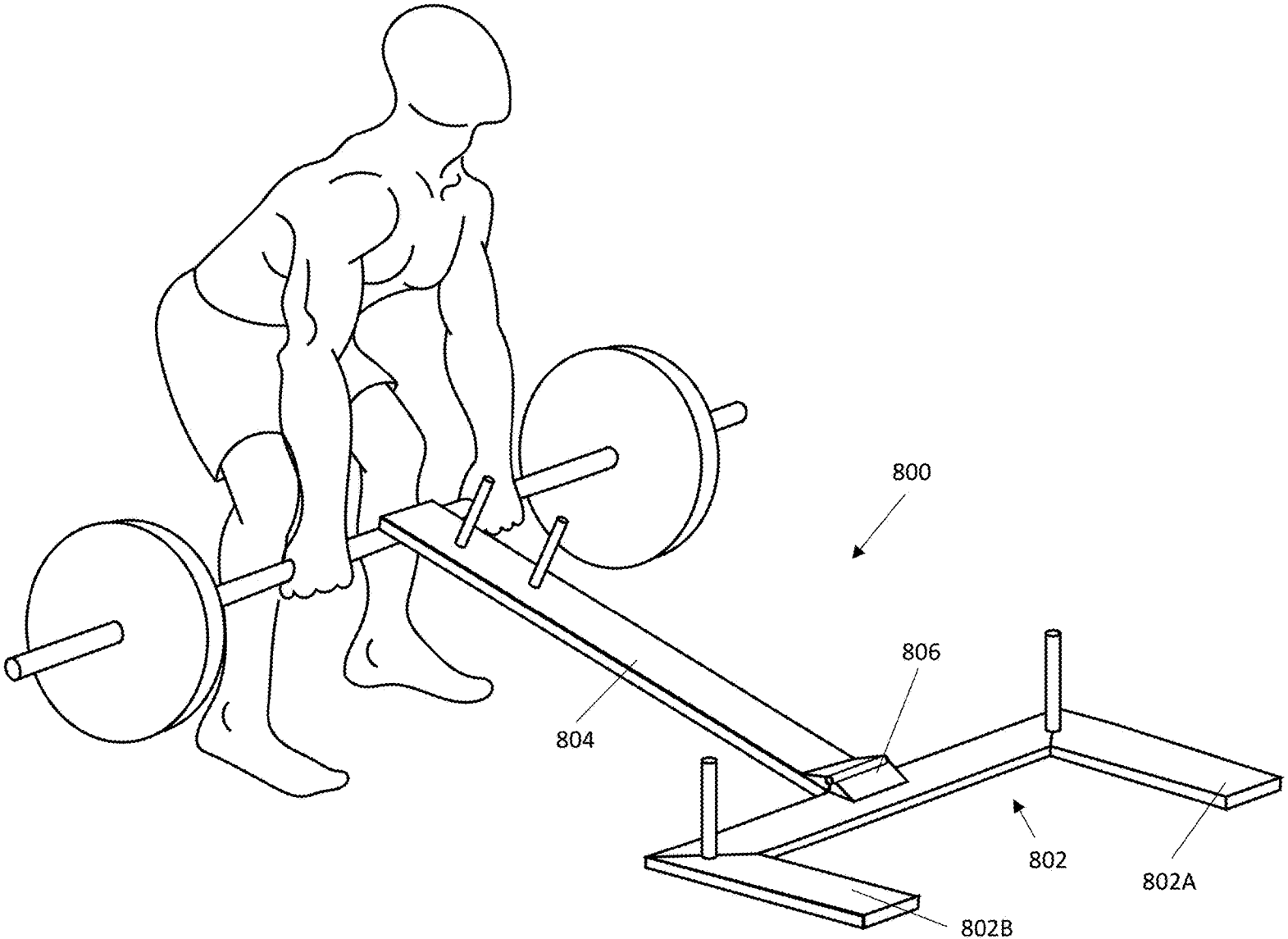
FIG. 8 is an alternate embodiment of the apparatus of FIG. 1, with the legs of the frame extending in the opposite direction from the arm.

Referring now generally to the Figures and particularly to FIG. 8, FIG. 8 is a second alternate preferred embodiment of the invented device ("a second device 800"), with a left side 802A and a right side 802B of the frame 802 extending in the opposite direction from an arm 804 rotatably coupled to the frame 802 by a hinge 806. This still provides the benefit of anchoring the arm 804 and facilitating the invented method of exercise, but may provide at least the additional benefit of allowing more space for the weightlifter 108 to place their feet, with the possible tradeoffs of less compact storage or taking up more floor space in a crowded gym.

While selected embodiments have been chosen to illustrate the invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment, it is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

I claim:

1. A weight lifting training device configured to increase a load experienced by a user during an initial section of a vertical lift, the device comprising:

an elongate bar with a proximate end and a rotatable end;

an anchor means rotatably and fixedly coupled with the rotatable end of the elongate bar, wherein the range of motion of the proximate end of the elongate bar is limited to an arcing travel path; and a barbell initially positioned underneath the elongate bar, wherein the proximate end of the elongate bar is at least partially and removably resting on the barbell, whereby vertical movement of the barbell causes both the elongate bar to break contact with the barbell and the proximate end of the elongate bar to fall away from the barbell after the barbell rises above the initial section of the vertical lift.

2. The device of claim 1, wherein the anchor means is comprised within a freestanding frame.

3. The device of claim 2, wherein the freestanding frame comprises a central beam extending substantively horizontally and perpendicularly from the elongate bar.

4. The device of claim 3, wherein the freestanding frame further comprises at least one stabilizing leg extending substantively horizontally from the central beam.

5. The device of claim 4, wherein the freestanding frame further comprises a second stabilizing leg extending substantively horizontally from the central beam.

6. The device of claim 5, wherein the at least one stabilizing leg and the second stabilizing leg each extend substantively perpendicularly from the central beam.

7. The device of claim 6, wherein the at least one stabilizing leg and the second stabilizing leg each extend substantively in parallel with the elongate bar.

8. The device of claim 7, wherein the at least one stabilizing leg and the second stabilizing leg each extend substantively in parallel with the elongate bar and toward the elongate bar proximate end.

9. The device of claim 7, wherein the at least one stabilizing leg and the second stabilizing leg each extend substantively in parallel with the elongate bar and away from the elongate bar proximate end.

10. The device of claim 5, wherein the at least one stabilizing leg and the second stabilizing leg each extend substantively toward the elongate bar proximate end.

11. The device of claim 5, wherein the at least one stabilizing leg and the second stabilizing leg each extend substantively away from the elongate bar proximate end.

12. The device of claim 4, wherein the at least one stabilizing leg extends substantively perpendicularly from the central beam.

13. The device of claim 1, further comprising a removable weight detachably coupled with the elongate bar.

14. The device of claim 1, wherein the anchor means is positioned below a highest point of the initial section of the vertical lift.

15. The device of claim 1, wherein the anchor means is coupled with a building structure.

16. The device of claim 1, further comprising an additional weight detachably attached to the elongate bar.

17. The device of claim 1, wherein the anchor means is positioned no more than three feet above the floor.

18. A method for weight training, comprising:

a. positioning a barbell underneath a proximate end of an elongate bar which is rotatably anchored at an opposite rotatable end;

b. initiating a vertical lifting of the barbell with the elongate bar positioned on top of the barbell;

c. continuing the vertical lifting of the barbell such that a limited arc of motion of the elongate bar causes the elongate bar to fall off of the barbell; and d. continuing the vertical lifting of the barbell free of the temporary extra weight of the elongate bar.

19. The method of claim 18, wherein the barbell is positioned between a user and the opposite rotatable end at which the elongate bar is anchored when causing the vertical lifting of the barbell.

20. A weight lifting training device configured to increase a load experienced by a user during an initial section of a vertical lift, the device comprising:

an elongate bar with a proximate end and a rotatable end;

an anchor means rotatably and fixedly coupled with the rotatable end of the elongate bar, wherein the range of motion of the proximate end of the elongate bar is limited to an arcing travel path; and a weighted bar initially positioned underneath the elongate bar, wherein the proximate end of the elongate bar is at least partially and removably resting on the weighted bar, whereby vertical movement of the weighted bar causes both the elongate bar to break contact with the weighted bar and the proximate end of the elongate bar to fall away from the weighted bar after the weighted bar rises above the initial section of the vertical lift.

* * * * *